US007058326B2

(12) United States Patent
Toyama

(10) Patent No.: US 7,058,326 B2
(45) Date of Patent: Jun. 6, 2006

(54) COLOR IMAGE FORMING APPARATUS

(75) Inventor: Hiroshi Toyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 21 days.

(21) Appl. No.: 10/698,018

(22) Filed: Oct. 31, 2003

(65) Prior Publication Data

US 2004/0141766 A1 Jul. 22, 2004

(30) Foreign Application Priority Data

Nov. 1, 2002 (JP) ..... P.2002-319356

(51) Int. Cl.
*G03G 15/02* (2006.01)

(52) U.S. Cl. ..... 399/50; 399/53; 399/54; 399/46

(58) Field of Classification Search ..... 399/50, 399/53–54, 55, 82, 85, 88, 89, 46; 361/225
See application file for complete search history.

(56) References Cited

U.S. PATENT DOCUMENTS 5,146,272 A * 9/1992 Watanabe ..... 399/53
5,734,390 A * 3/1998 Sakaizawa et al. ..... 347/2

FOREIGN PATENT DOCUMENTS

JP 2002-162801 A 6/2002

* cited by examiner

*Primary Examiner*—Hoang Ngo
(74) *Attorney, Agent, or Firm*—Sughrue Mion, PLLC

(57) ABSTRACT

A color image forming apparatus includes a plurality of image carriers for at least one color, a plurality of developing devices, each developing a toner image onto each image carrier, a plurality of charging devices, each charging the each image carrier, a first power source, connected to the developing devices in common, a second power source, connected to the charging devices in common, and a controller, changing a process control of at least one of the charging devices and the developing devices in accordance with a color image forming operation and a monochrome image forming operation.

11 Claims, 10 Drawing Sheets

COLOR IMAGE FORMING APPARATUS

BACKGROUND OF THE INVENTION

The present invention relates to a color image forming apparatus for preventing a deterioration in picture quality and the wasteful consumption of a toner when carrying out printing in a monochrome mode in a structure in which the power sources of a charging device and a developing device are shared.

A color image forming apparatus of a tandem type is provided with four image units for forming monochromatic toner images of yellow (Y), magenta (M), cyan (C) and black (Bk). A photosensitive drum or the like served as a charging device, a developing device and a latent image carrier is provided in each of the image units. The charging devices and the developing devices for the respective colors are connected to power sources provided individually. The color image forming apparatus is used in a color mode and a monochrome mode.

In the color image forming apparatus having the above structure, a charging potential to be desired for charging the latent image carrier is high in some cases. In these cases, a large quantity of charge is to be supplied. For this reason, a memory is apt to be generated on the latent image carrier due to an insufficient charging capability. In the case in which the memory is generated on the latent image carrier, moreover, a variation in the potential is increased if the charging potential is high. Consequently, a deterioration in picture quality becomes more remarkable.

In the case in which an operation is to be carried out in the color mode, particularly, a gradation property is important for the picture quality. Therefore, there is such a demand that the charging potential is to be lowered as much as possible. If the charging potential is too low, however, an inverse contrast to the developed portion of a latent image is reduced so that so-called "scumming" on a white background is generated in a recording medium such as a recording paper. Therefore, the charging potential is set to a voltage so that the "scumming" is not generated.

In the case in which the charging potential is set to be such a voltage that the "scumming" is not generated, thus, the contamination of the recording medium cannot be visually confirmed. In the case in which the image forming apparatus is operated in the color mode, however, it is confirmed that a small amount of toner is consumed and is stuck onto the recording medium if a concentration measurement and a microscopic observation are carried out. For this reason, there is still a problem in that the picture quality is deteriorated and the toner is wastefully consumed.

In the color image forming apparatus in which the color mode and the monochrome mode are performed together, printing is often carried out in the monochrome mode in which only characters are actually printed. There is a problem in that the picture quality is deteriorated and the toner is wastefully consumed as described above when the printing in the monochrome mode is carried out while a color image forming section is operated. For this reason, in the case in which the printing is carried out in the monochrome mode, a power source connected to the color image forming section is turned OFF or the operation of a developing unit is stopped.

However, there is a problem in that a control circuit is complicated when a control for turning OFF the power source of the color image forming section and a processing of stopping the operation of the developing unit are carried out. With such a structure that the charging devices and the developing devices for the respective colors are connected to the power sources provided individually, moreover, there is a problem in that the cost of power equipment is increased.

In order to take a countermeasure against these problems, there has been such a trial as to share the power sources of the charging device and the developing device which are provided for each color, thereby reducing the expense of the power equipment (for example, see JP-A-2002-162801). In this case, the same voltage is applied from the common power source to the charging devices for the respective colors. Moreover, the same voltage is applied from a common power source to the developing devices for the respective colors. Therefore, there is an advantage that the cost of the power equipment can be reduced.

In the structure disclosed in JP-A-2002-162801, printing in a monochrome mode is carried out while a color image forming section is operated since a common power source for each color is used. For this reason, there is a problem in that the picture quality is deteriorated and the toner is unnecessarily consumed.

SUMMARY OF THE INVENTION

It is therefore an object of the present invention to provide a color image forming apparatus for preventing a deterioration in picture quality and the wasteful consumption of a toner when carrying out printing in a monochrome mode in such a structure that the power sources of a charging device and a developing device are shared.

In order to achieve the above object, according to the present invention, there is provided a color image forming apparatus, comprising:

a plurality of image carriers for at least one color;

a plurality of developing devices, each developing a toner image onto each image carrier;

a plurality of charging devices, each charging the each image carrier;

a first power source, connected to the developing devices in common;

a second power source, connected to the charging devices in common; and a controller, changing a process control of at least one of the charging devices and the developing devices in accordance with a color image forming operation and a monochrome image forming operation.

In the above configuration, it is possible to carry out the process control in order to suppress the wasteful consumption of a toner and to prevent a deterioration in picture quality during the operation in the monochrome image forming operation.

Preferably, the first power source includes a variable voltage DC power source and a variable frequency AC power source.

In the above configuration, it is possible to set the voltage value of a DC power source and the frequency of an AC power source to be optimum values, thereby carrying out the process control of the developing devices.

Preferably, the second power source includes a variable voltage DC power source and a variable voltage AC power source.

In the above configuration, it is possible to set the voltage value of the DC power source and the voltage value of the AC power source to be optimum values, thereby carrying out the process control of the charging devices.

Preferably, each charging device includes either a roller charging mechanism or a brush charging mechanism. Each developing device includes either a contact developing mechanism or a non-contact developing mechanism.

In the above configuration, it is possible to carry out the process control of the charging devices and the developing devices including these mechanisms on optional conditions.

Preferably, each charging device includes a roller charging mechanism. Each developing device includes a contact developing mechanism.

In the above configuration, it is possible to particularly carry out the process control of the charging devices and the developing devices including these mechanisms on optional conditions.

Preferably, each charging device includes a brush charging mechanism. Each developing device includes a non-contact developing mechanism.

In the above configuration, it is possible to particularly carry out the process control of the charging devices and the developing devices including these mechanisms on optional conditions.

Preferably, the process control includes at least one of a control of a charging bias voltage for applying the charging devices and a control of a developing bias voltage for applying the developing devices.

In the above configuration, it is possible to control at least one of the charging bias voltage and the developing bias voltage, thereby preventing a deterioration in picture quality and suppressing the wasteful consumption of a toner.

Here, it is preferable that, the charging bias voltage includes either a DC voltage to be singly applied or an alternating voltage superposed with the DC voltage.

In the above configuration, it is possible to control the charging bias voltage corresponding to such a situation that a variation in a potential is to be lessened or the life of the AC power source is to be prolonged.

Here, it is preferable that, the developing bias voltage includes either a DC voltage to be singly applied or an alternating voltage superposed with the DC voltage.

In the above configuration, it is possible to control a developing bias voltage corresponding to the manner of use as to whether a contact developing mechanism is used or a non-contact developing mechanism is used as the developing device.

Here, it is preferable that, the controller changes the control of the charging bias voltage so as to set a voltage in the monochrome image forming operation higher than a voltage in the color image forming operation.

In the above configuration, an inverse contrast potential in a non-image section can be increased. Consequently, it is possible to suppress the wasteful consumption of a toner.

Here, it is preferable that, wherein the controller changes the control of the developing bias voltage so as to set a frequency of an alternating voltage in the monochrome image forming operation higher than a frequency of an alternating voltage in the color monochrome image forming operation.

In the above configuration, although a dot size is large, it is possible to suppress the generation of scumming in the non-image section, thereby preventing a deterioration in picture quality.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 2:
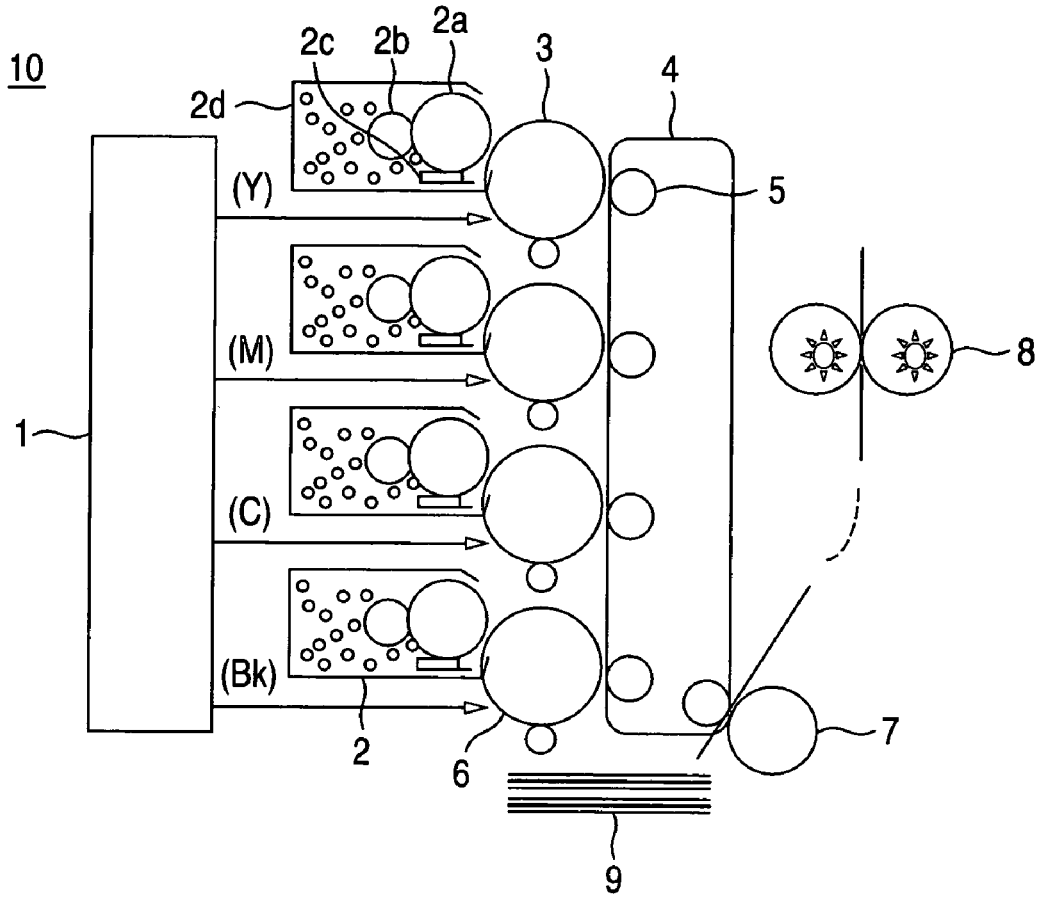
FIG. 2 is a view showing a structure of a color image forming apparatus of a tandem type.

A color image forming apparatus according to an embodiment of the invention will be described below. FIG. 2 is a view showing a structure according to a color image forming apparatus of a tandem type of the invention. In FIG. 2, a color image forming apparatus 10 has an image units for forming monochromatic toner images of yellow (Y), magenta (M), cyan (C) and black (Bk) respectively. 1 denotes an exposing device and 2 denotes a developing device for each color. For example, the developing device for the yellow (Y) will be described, and a developing roller 2*a*, a toner supply roller 2*b* and a toner regulating blade 2*c* are provided. Moreover, a cartridge is filled with a toner 2*d*.

The other developing devices for the magenta (M), the cyan (C) and the black (Bk) also have the same structures. 3 denotes a photosensitive drum, 4 denotes an intermediate transfer belt as a transfer member, 5 denotes a primary transfer roller, 6 denotes a charging roller, 7 denotes a secondary transfer roller, 8 denotes a fixing roller and 9 denotes a transfer material such as a recording paper. Thus, the image unit for each color of the color image forming apparatus 10 is constituted by members such as the developing device 2, the photosensitive drum 3, the primary transfer roller 5 and the charging roller 6.

Next, description will be given to a schematic operation in the color mode of the color image forming apparatus in FIG. 2. A photosensitive drum 3 for the yellow (Y) is charged to a negative voltage, for example, −600V by the charging device 6. Next, an electrostatic latent image is formed on the photosensitive drum 3 for the yellow (Y) with a ray radiated from the exposing device 1. Subsequently, an electrostatic latent image formed on the photosensitive drum 3 is developed in a portion for the yellow color of the developing device 2. A positive voltage, for example, +700V is applied to the primary transfer roller 5 and an yellow developed image (a toner image) on the photosensitive drum 3 is transferred onto the intermediate transfer belt 4.

Subsequently, the same processing is repeated during the movement of the intermediate transfer belt 4 for the magenta (M), the cyan (C) and the black (Bk), and the developed images of the magenta, the cyan and the black are sequentially superposed on the yellow developed image transferred onto the intermediate transfer belt 4 and are thus transferred. When the developed images having four colors are transferred to the intermediate transfer belt 4, the transfer material 9 abuts on the secondary transfer roller 7 in a delivery path. In this case, a transfer bias voltage applied from a high-voltage power source is applied to the secondary transfer roller 7.

Thus, a full color toner image formed on the intermediate transfer belt 4 is transferred to the transfer material 9 in the position of the secondary transfer roller 7. The transfer material 9 having the full color toner image transferred thereto is delivered to the fixing device 8. In the fixing device 8, the toner image on the transfer material 9 is fused and fixed by heat and pressure. In case of continuous printing, the operation is repeated. During the operation in the monochrome mode, the charging device, the developing device and the exposing device corresponding to the black (Bk) are operated to carry out the processing and to transfer a monochromatic image from the intermediate transfer belt 4 onto the transfer material 9. Thus, the color image forming apparatus carries out a process control such as the application of a developing bias voltage by the developing device 2 or the application of a charging bias voltage by the charging device 6.

Figure 3:
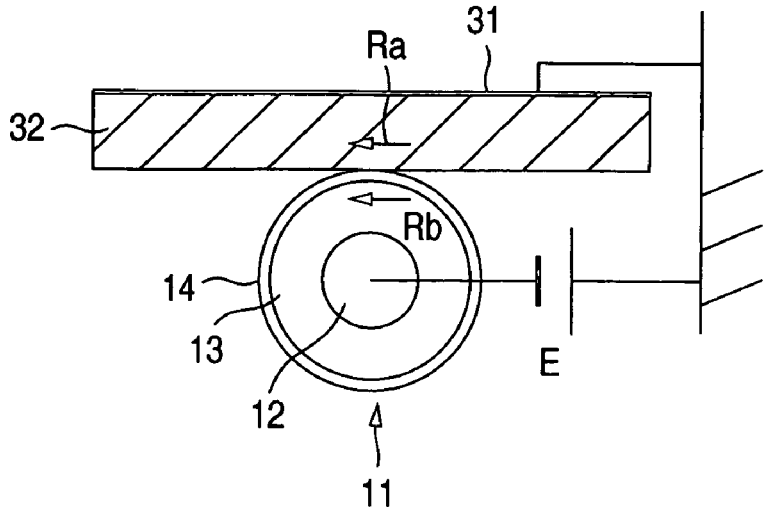
FIG. 3 is an explanatory view showing a roller charging mechanism.

Next, description will be given to the charging device used in the image forming apparatus in FIG. 2. For the charging device, a roller charging mechanism and a brush charging mechanism can be used. FIG. 3 is an explanatory view showing the roller charging mechanism. In FIG. 3, 11 denotes a charging roller which has a core metal 12, an elastic layer 13 and a surface layer 14. 31 denotes a photosensitive base material and 32 denotes a photosensitive layer. Moreover, E is a charging power source which is connected between the core metal 12 of the charging roller 11 and a ground and serves to apply a charging bias voltage to the charging roller 11.

A voltage is directly applied from the charging power source E to the core metal 12. For the elastic layer 13, a material having an electric resistance of approximately $10^5$ to $10^8$ Ω·cm is used. The surface layer 14 serves to protect the photosensitive drum and the charging roller 11. When the charging roller 11 comes in contact with the photosensitive layer 32 of the photosensitive drum so that the photosensitive drum is rotated in a direction of an arrow Ra, driving force is transmitted to the charging roller 11 and thereby the charging roller 11 is rotated in a direction of an arrow Rb together with the photosensitive layer 32. A discharge is generated by a potential difference made on the surface of the charging roller 11 and that of the photosensitive drum, and the photosensitive drum is charged by a generated ion.

The discharge is not generated until the potential difference has a certain value or more, and a voltage at which the discharge is generated will be referred to as a breakdown voltage. As a result, a following characteristic can be obtained.

$$|\text{charging potential}| = |\text{applied voltage}| - |\text{breakdown voltage}|$$

Accordingly, it is preferable to raise the applied voltage in order to increase the charging potential. For example, when the breakdown voltage is 600V, the charging potential is −520V if the applied voltage is set to be −1120V.

In order to set the charging potential to be −620V, it is preferable to set the applied voltage to be −1220V. Moreover, there is also a method of superposing an alternating current on the applied voltage. In this case, for example, if the DC voltage is set to be −520V and the alternating voltage is set to be 1300V, the charging potential is −520V. When the alternating voltage is superposed on the DC voltage, a potential unevenness is lessened and an advantage can be produced to obtain an image of high picture quality. However, power equipment becomes expensive.

Figure 4:
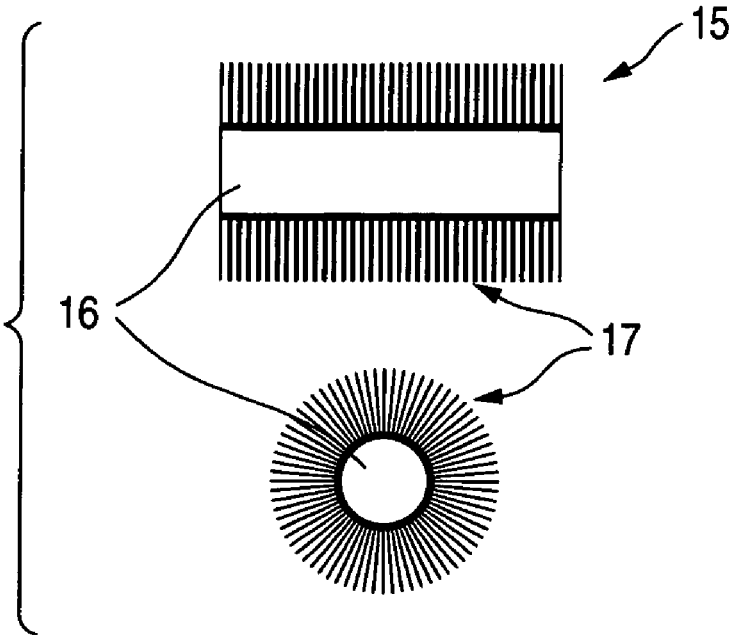
FIG. 4 is an explanatory view showing a brush charging mechanism.
Figure 5:
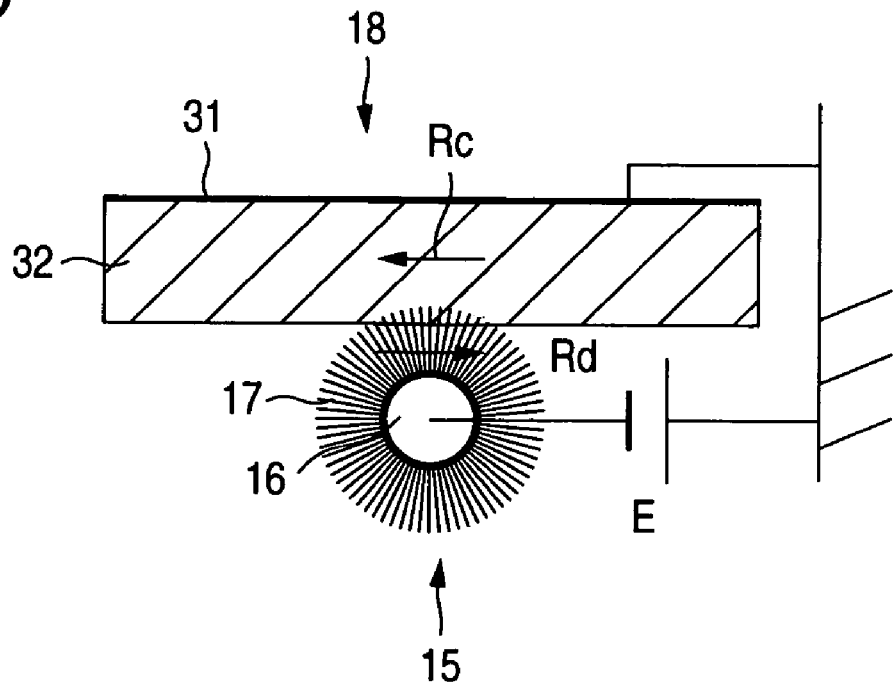
FIG. 5 is an explanatory view showing the brush charging mechanism.

FIGS. 4 and 5 are explanatory views showing a brush charging mechanism 18. In the drawings, 15 denotes a brush roller, 16 denotes a core metal, 17 denotes a brush, 31 denotes a photosensitive base material, and 32 denotes a photosensitive layer. Moreover, E denotes a charging power source for applying a charging bias voltage to the brush roller 15. The brush charging mechanism 18 forms a potential difference between the brush 17 and the surface of the photosensitive drum in the same manner as the roller charging mechanism, and charges the photosensitive drum with ions generated by a discharge.

Differently from the charging roller 11, the contact of the brush 17 with the photosensitive layer 32 is nonuniform and the potential unevenness is apt to be caused. When the photosensitive drum is rotated in a direction of an arrow Rc, therefore, the brush 17 is reversely rotated in a direction of an arrow Rd. Thus, a difference in a circumferential speed is made on the rotation with the photosensitive drum in order to cause the contact to be uniform. In the application of the charging bias voltage, moreover, the potential unevenness is effectively lessened by superposing the alternating voltage on the DC voltage. For example, if the DC voltage is set to be −600V and an alternating voltage of 800V at 1 KHz is applied, the charging potential is approximately −600V. In the case in which the charging potential is to be raised to −700V, for example, it is preferable to set the DC voltage to be −700V.

Figure 6:
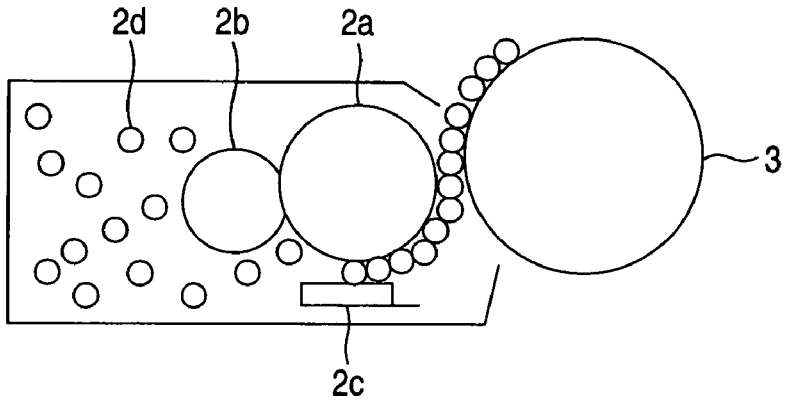
FIG. 6 is an explanatory view showing a contact developing mechanism.

Next, the developing mechanism will be described. For the developing mechanism, similarly, the contact developing mechanism and the non-contact mechanism are used. FIG. 6 is an explanatory view showing the contact developing mechanism. In FIG. 6, typically, **2*a* denotes a developing roller for the contact developing mechanism, 2*b* denotes a toner supply roller, 2*c* denotes a toner regulating blade and 2*d* denotes a toner accommodated in a cartridge. 3** denotes a photosensitive drum.

In the contact developing mechanism, as shown in FIG. 6, the developing roller **2*a* is caused to come in contact with the photosensitive drum 3 to apply a developing voltage (Vb) to the developing roller 2*a*. In this case, a potential difference is made together with a surface potential (Vs) of the photosensitive drum 3, and the toner 2***d* is developed based on the potential difference. Thus, a potential distribution is generated on the surface of the photosensitive drum 3 by charging and exposure, and the developing roller 2*a* to which a certain developing bias voltage Vb is applied is caused to come in contact with the photosensitive drum 3 so that a toner image can be formed on the photosensitive drum 3.

Figure 7:
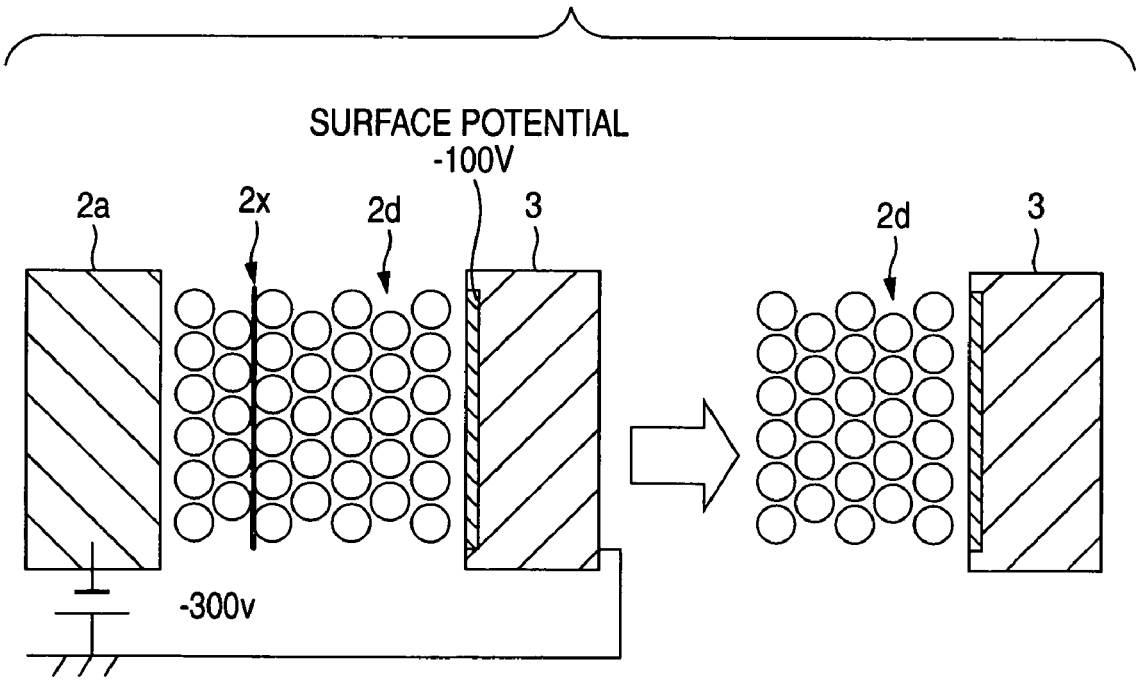
FIG. 7 is an explanatory view showing a condition in which a toner image is formed on a photosensitive drum.
Figure 8:
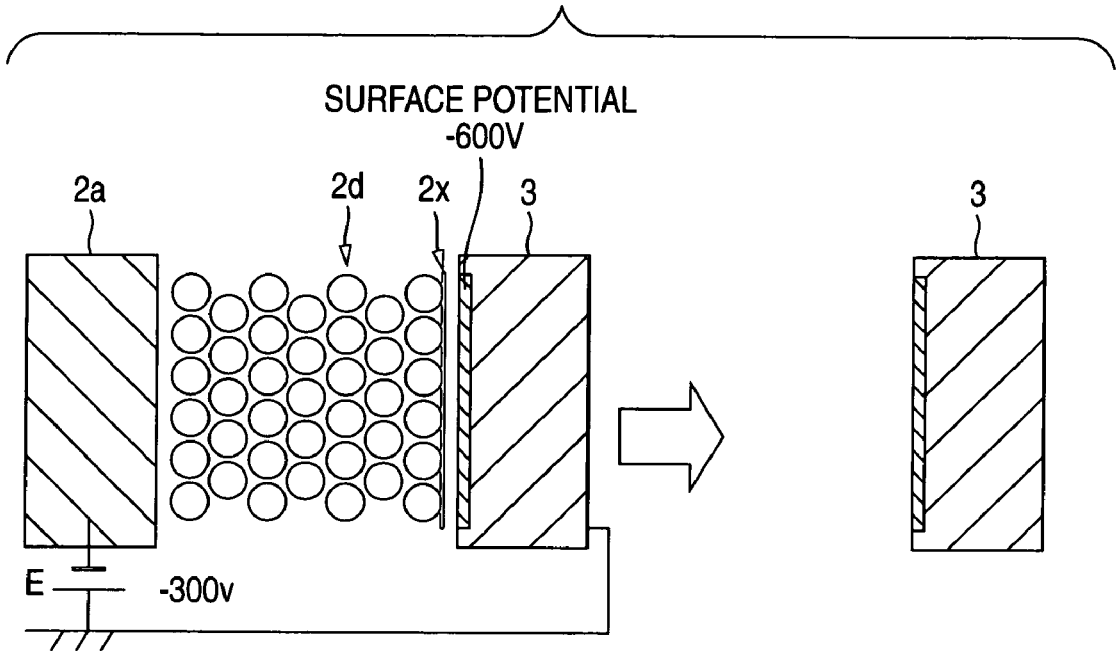
FIG. 8 is an explanatory view showing a condition in which a toner image is formed on the photosensitive drum.

In particular, the case in which the polarity of the surface potential of the photosensitive drum .3 is the same as that of the toner 2*d* is referred to as an inversion development, and the toner 2*d* receives force toward such a direction that the absolute value of the potential is decreased. Therefore, a toner image is formed when the developing roller 2*a* and the photosensitive drum 3 are separated from each other. FIGS. 7 and 8 are explanatory views showing a condition in which a toner image is formed on the photosensitive drum 3. In FIG. 7, a developing bias voltage Vb=−300V is supplied to the developing roller 2*a* and a potential distribution having a surface potential of −600V (FIG. 8) to −100V (FIG. 7) is formed on the photosensitive drum 3.

At this time, the toner 2*d* receives force in such a direction that the absolute value of the potential is decreased. For this reason, in a portion in which the surface potential of the photosensitive drum 3 is −100V as shown FIG. 7, the toner 2*d* receives force in the direction of the photosensitive drum 3. In a portion in which the surface potential is −600V as shown in FIG. 8, moreover, the toner 2*d* receives force in the direction of the developing roller 2*a*. In the toner layer, the force receiving toward the developing roller 2*a* side and the force receiving toward the photosensitive drum 3 side are balanced with each other to form a boundary line in which the force is not received by any of them.

Figure 9:
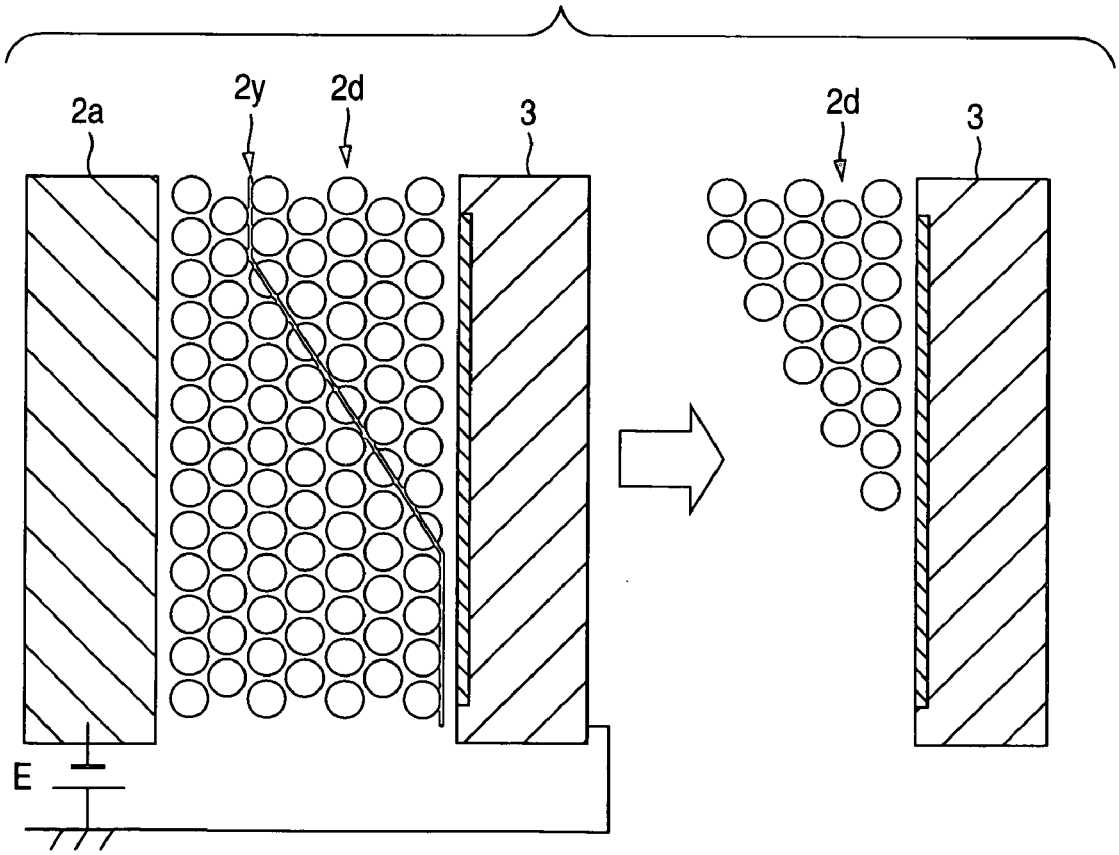
FIG. 9 is an explanatory view showing a condition of a boundary line formed in a gap.

FIGS. 7 and 8 show the boundary line in a line 2*x*. FIG. 9 is an explanatory view showing a general boundary line. It is assumed that the boundary line is formed in a bent line 2*y* as shown in FIG. 9 by the influence of the potential distribution of the photosensitive drum 3. In this case, the toner 2*d* on the photosensitive drum 3 side from the boundary line 2*y* is developed onto the photosensitive drum 3. Moreover, the toner 2*d* on the developing roller 2*a* side is recovered by the developing roller 2*a*.

Figure 10:
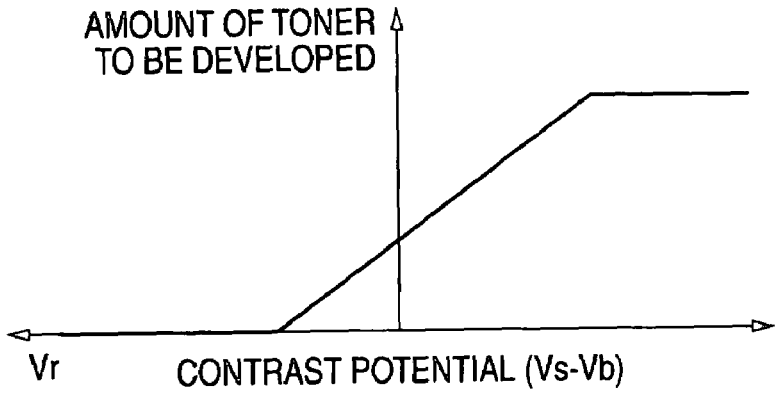
FIG. 10 is a characteristic chart showing the relationship between a toner amount and a contrast potential.
Figure 11:
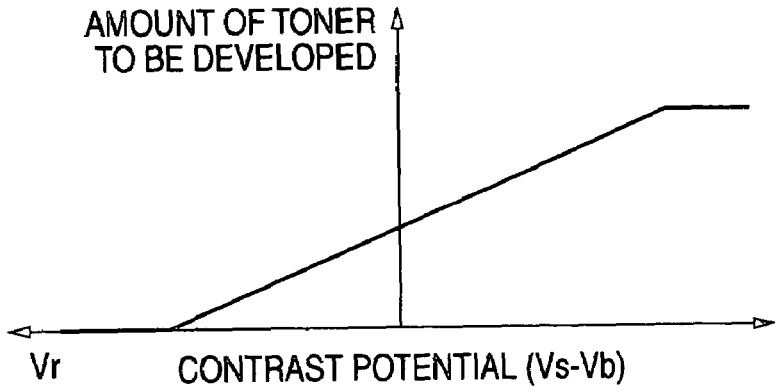
FIG. 11 is a characteristic chart showing the relationship between the toner amount and the contrast potential.
Figure 12:
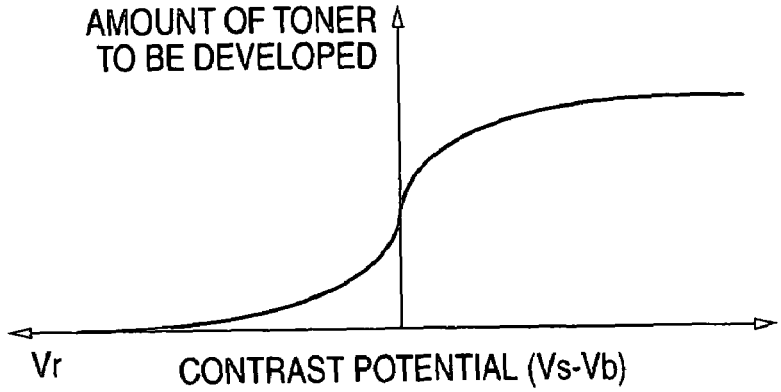
FIG. 12 is a characteristic chart showing the relationship between the toner amount and the contrast potential.

Next, the amount of the toner 2*d* developed onto the photosensitive drum 3 will be described. FIGS. 10 to 12 are characteristic charts showing the relationship between the amount of a toner developed onto the photosensitive drum 3 and a contrast potential. The contrast potential is a difference between the developing bias voltage Vs to be applied to the developing roller and the surface potential Vb of the photosensitive drum. As shown in FIG. 7, when the contrast potential is raised, the amount of the toner to be developed is increased in proportion to the contrast potential. When the contrast potential reaches a certain potential, a toner image to be developed is saturated. A contrast potential (an inverse contrast potential) Vr on the negative side serves to form a non-image section in which the toner is not developed onto the photosensitive drum.

There will be investigated the case in which the charging amount of the toner is increased. In this case, as shown in FIG. 11, it is necessary to increase a contrast potential for developing the toner onto the photosensitive drum (an image section). In order not to develop the toner onto the photosensitive drum (a non-image section), moreover, the contrast potential (the inverse contrast potential) Vr on the negative side is to be also raised. The reason is that a large number of electric charges are to be moved in order to move the toner because of an increase in the charging amount. For this reason, it is necessary to make a greater potential difference in order to move a large number of electric charges.

Actually, the charging amounts of the toner are varied individually and have a distribution. For this reason, the amount of the toner to be developed has a curved characteristic shown in FIG. 12 with respect to the contrast potential. As is apparent from FIG. 12, toner consumption is more lessened by such a control as to increase a contrast potential (Vs−Vb) toward a negative side in the non-image section, that is, to increase the inverse contrast potential Vr.

Figure 13:
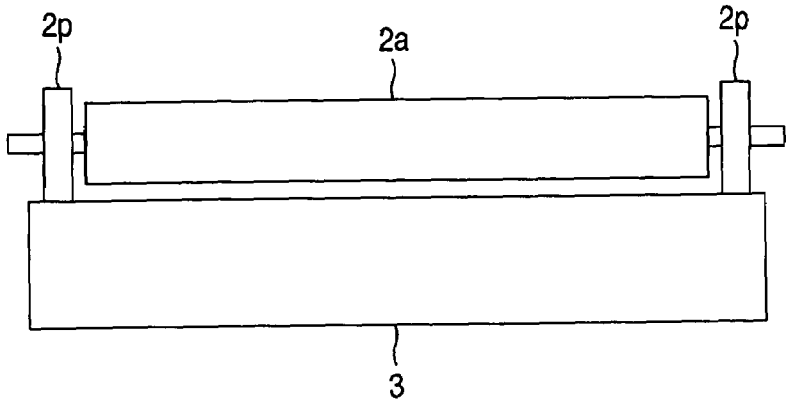
FIG. 13 is an explanatory view showing a non-contact developing mechanism.

FIG. 13 is an explanatory view showing the non-contact developing mechanism. In FIG. 13, 2*a* denotes a developing roller, 2*p* denotes a roller and 3 denotes a photosensitive drum. As shown in FIG. 13, in the non-contact developing mechanism, a gap is formed between the developing roller 2*a* and the photosensitive drum 3 by using the roller 2*p*. Then, a toner is scattered beyond the gap, thereby carrying out a development onto the photosensitive drum 3.

Figure 14:
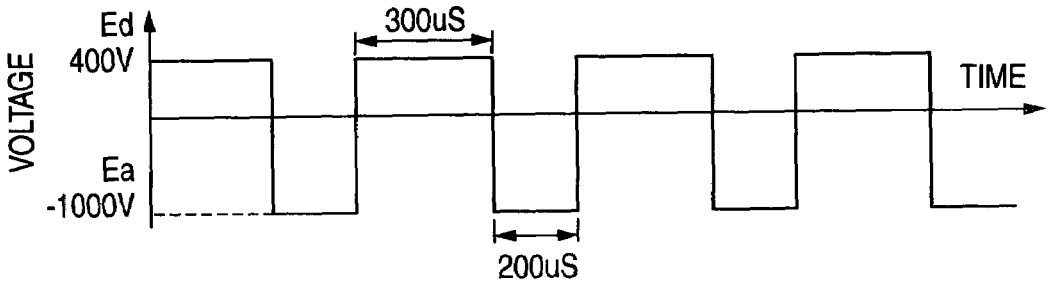
FIG. 14 is a characteristic chart showing the waveform of a bias voltage.

FIG. 14 is a characteristic chart showing the waveform of a bias voltage to be applied to the developing roller 2*a*. As shown in FIG. 14, the waveform of the bias voltage to be applied to the developing roller is an alternating waveform. The waveform of the bias voltage is formed by a rectangular wave alternately forming Vb=−1000V for 200 μs and Vb=400V for 300 μs, for example. In this case, a peak value (PP) is 1400 V. Moreover, a cycle (duty) is 300/(300+200)=0.6, that is, 60%. Such a rectangle wave can be formed by a pulse generating circuit.

Figure 15:
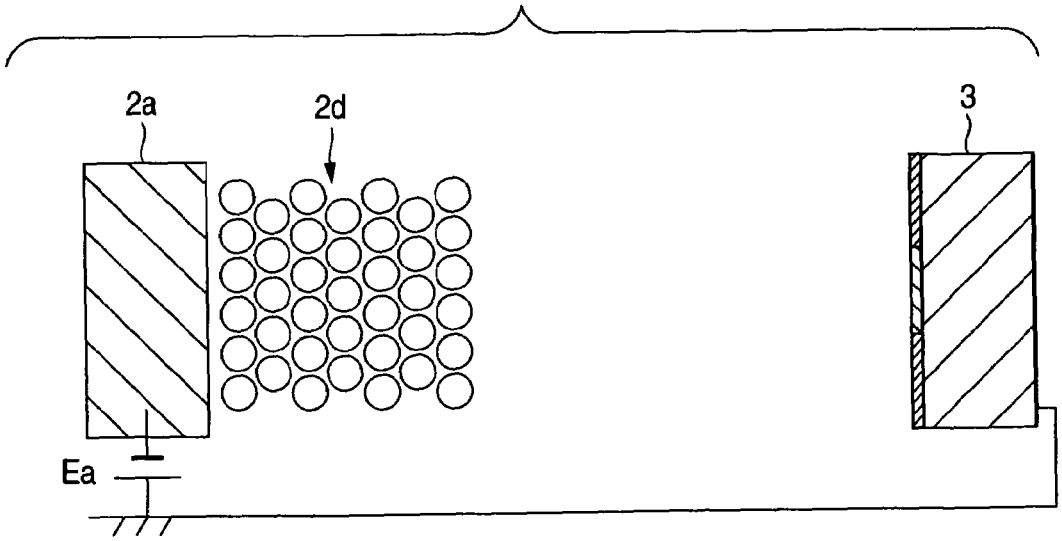
FIG. 15 is an explanatory view showing the relationship between the bias voltage and the movement of a toner.
Figure 16:
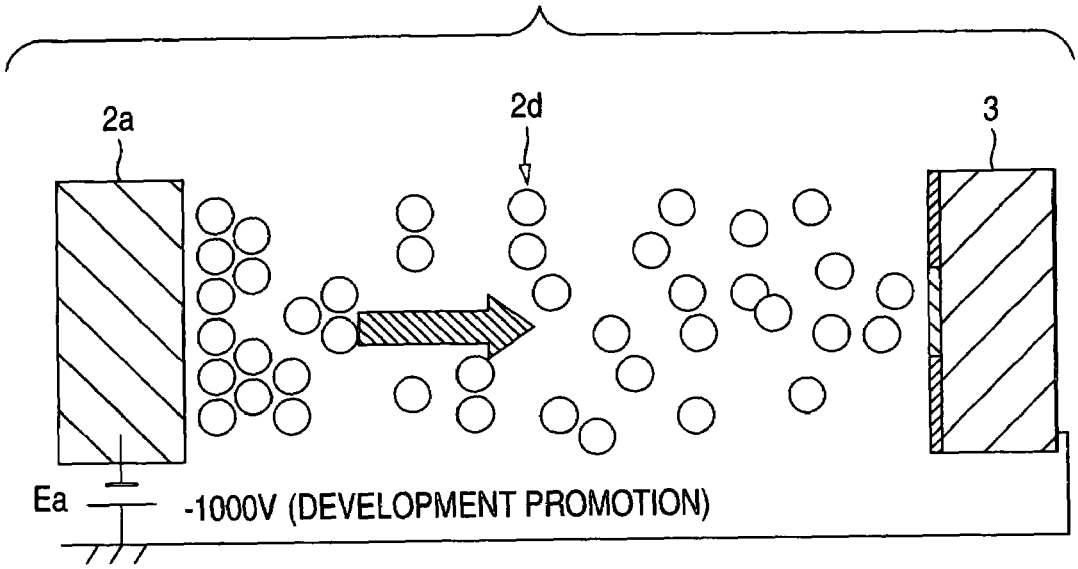
FIG. 16 is an explanatory view showing the relationship between the bias voltage and the movement of the toner.
Figure 17:
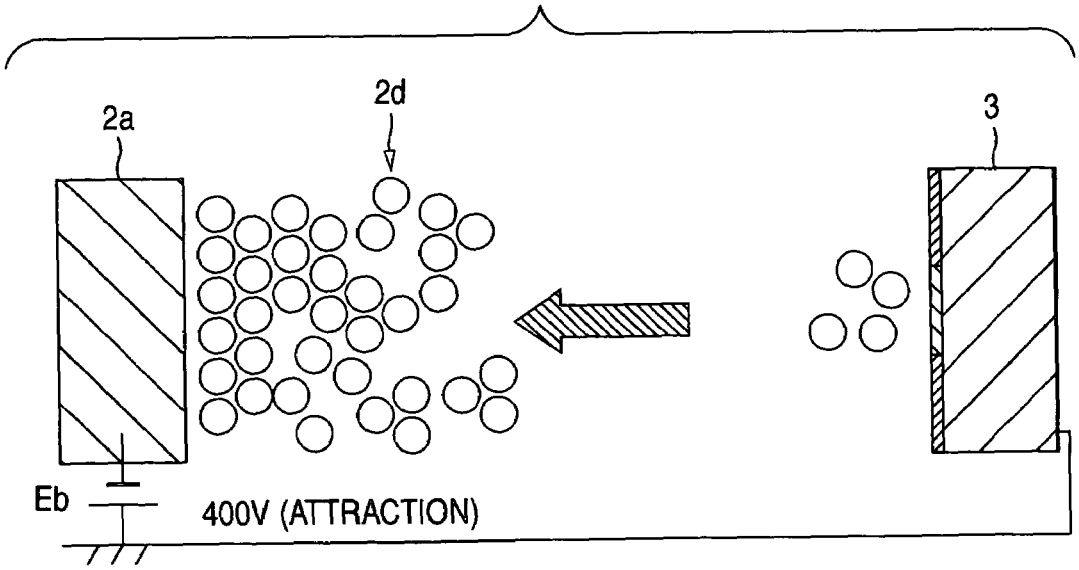
FIG. 17 is an explanatory view showing the relationship between the bias voltage and the movement of the toner.

FIGS. 15 to 17 are explanatory views showing the relationship between a bias voltage to be applied to the developing roller and the movement of a toner. FIG. 15 shows an initial state in which it is assumed that a negative voltage Ea is applied to the developing roller 2*a*. FIG. 16 shows the state of the toner 2*d* which is obtained when Ea=−1000V in the bias voltage described with reference to FIG. 14 is applied to the developing roller 2*a*. Moreover, FIG. 17 shows the state of the toner 2*d* which is obtained when Eb=400V in the bias voltage described with reference to FIG. 14 is applied to the developing roller 2*a*.

As shown in FIG. 16, the toner 2*d* flies toward the photosensitive drum 3 when a bias voltage of −1000 V is applied. As shown in FIG. 17, moreover, when a bias voltage of 400V is applied, the toner 2*d* is recovered by the developing roller 2*a*. Thus, the toner 2*d* reciprocates in a gap formed between the developing roller 2*a* and the photosensitive drum 3. Consequently, a latent image obtained by charging and exposure can be finely developed onto the photosensitive drum 3.

As conditions for the foregoing, it is necessary to sufficiently give a time taken for applying a bias voltage to promote a development with respect to the flight speed of the toner 2*d* (in this case, the bias voltage=−1000V) and a bias voltage for recovering the toner 2*d* (in this case, the bias voltage=400V) respectively. Since the toner 2*d* also comes in contact with the non-image section of the photosensitive drum 3 several times, some toner 2*d* cannot be recovered from the photosensitive drum 3 (FIG. 17). For this reason, the toner 2*d* is gradually consumed by the photosensitive drum 3.

Figure 18:
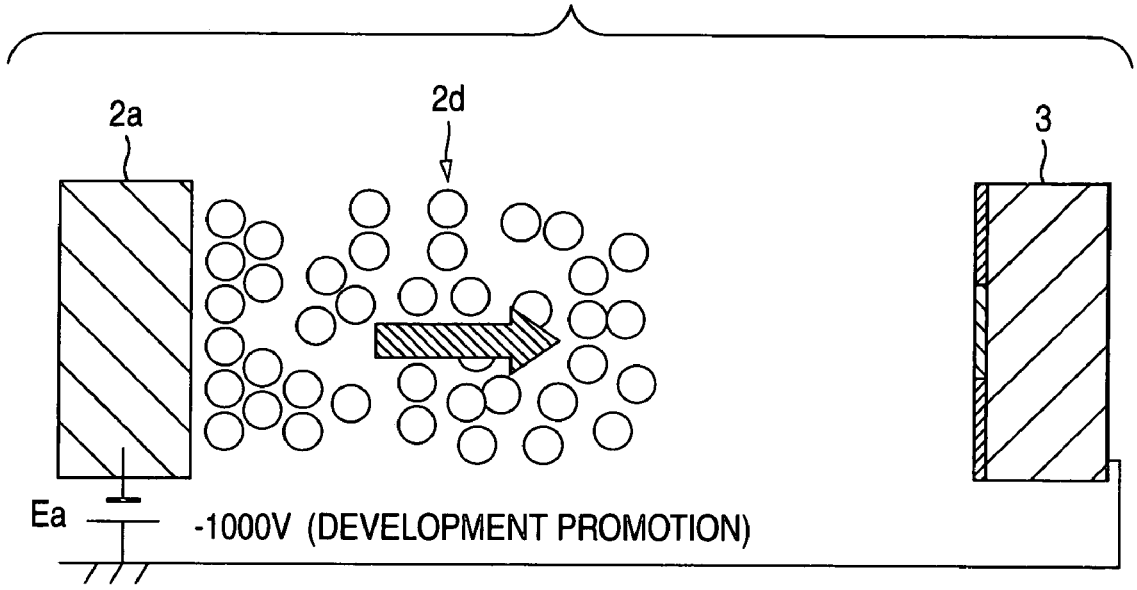
FIG. 18 is an explanatory view showing the relationship between the bias voltage and the movement of the toner.
Figure 19:
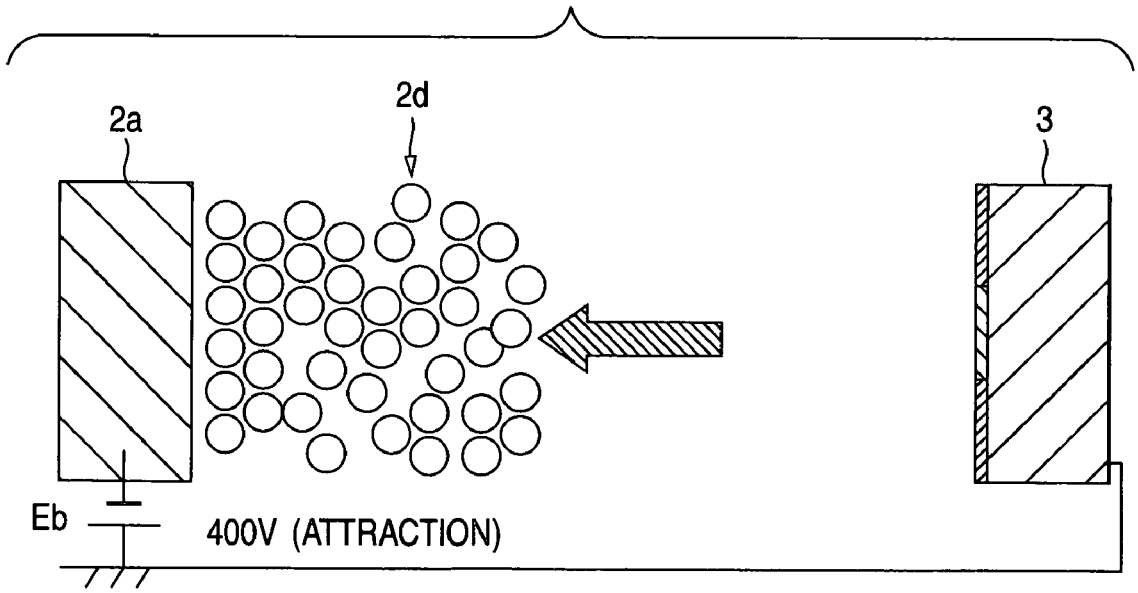
FIG. 19 is an explanatory view showing the relationship between the bias voltage and the movement of the toner.

In the case in which the time taken for applying a bias voltage is not sufficient, a latent image formed on the photosensitive drum 3 cannot be developed finely. The reason is that the reciprocation of the toner 2*d* between the developing roller 2*a* and the photosensitive drum 3 cannot fully be carried out. For example, when the time taken for applying a bias voltage is set to be 100 μS at a bias voltage (−1000V) on the promoting side and is set to be 150 μS at a bias voltage (400V) on the attracting side respectively, the toner 2*d* does not reach the photosensitive drum 3 as shown in an explanatory view of FIG. 18. In this case, the toner 2*d* staying in the gap is exactly attracted into the developing roller 2*a* as shown in an explanatory view of FIG. 19.

In the case in which the size of a dot is small and the absolute value of the mean surface potential of the photosensitive drum 3 is great, the toner 2*d* does not reach the photosensitive drum 3. On the other hand, in the case in which the size of the dot is great and the absolute value of the mean surface potential of the photosensitive drum 3 is small, the toner 2*d* is gradually moved toward the photosensitive drum 3. Consequently, the development can be carried out.

As a result, if the times taken for applying a bias voltage on the development promoting side and the attracting side are shortened respectively, that is, a frequency is raised, it is hard to faithfully carry out the development for the size of the dot. However, the consumption of the toner 2*d* in the non-image section is eliminated. In the invention, the characteristic of the toner movement is noted to set the frequency of the alternating bias voltage to be high in the monochrome mode, thereby preventing the wasteful consumption of the toner and a deterioration in picture quality.

In the invention, the charging device is constituted by (a) the roller charging mechanism or (b) the brush charging mechanism. Moreover, the developing device is constituted by (c) the contact developing mechanism or (d) the non-contact developing mechanism. Accordingly, the degree of freedom in the combination of the charging device and the developing device is increased so that the process control of the charging device and the developing device comprising these mechanisms can be carried out on optional conditions.

Suitably, the charging device is constituted by the roller charging mechanism and the developing device is constituted by the contact developing mechanism. Moreover, the charging device is constituted by the brush charging mechanism and the developing device is constituted by the non-contact developing mechanism. By such a combination, the process control of the charging device and the developing device can be carried out on the optional conditions as described with reference to FIGS. 7 to 19. More specifically, the application of the charging bias voltage and that of the developing bias voltage can be set to suppress the generation of scumming in a white background portion and to prevent the wasteful consumption of the toner.

Figure 1:
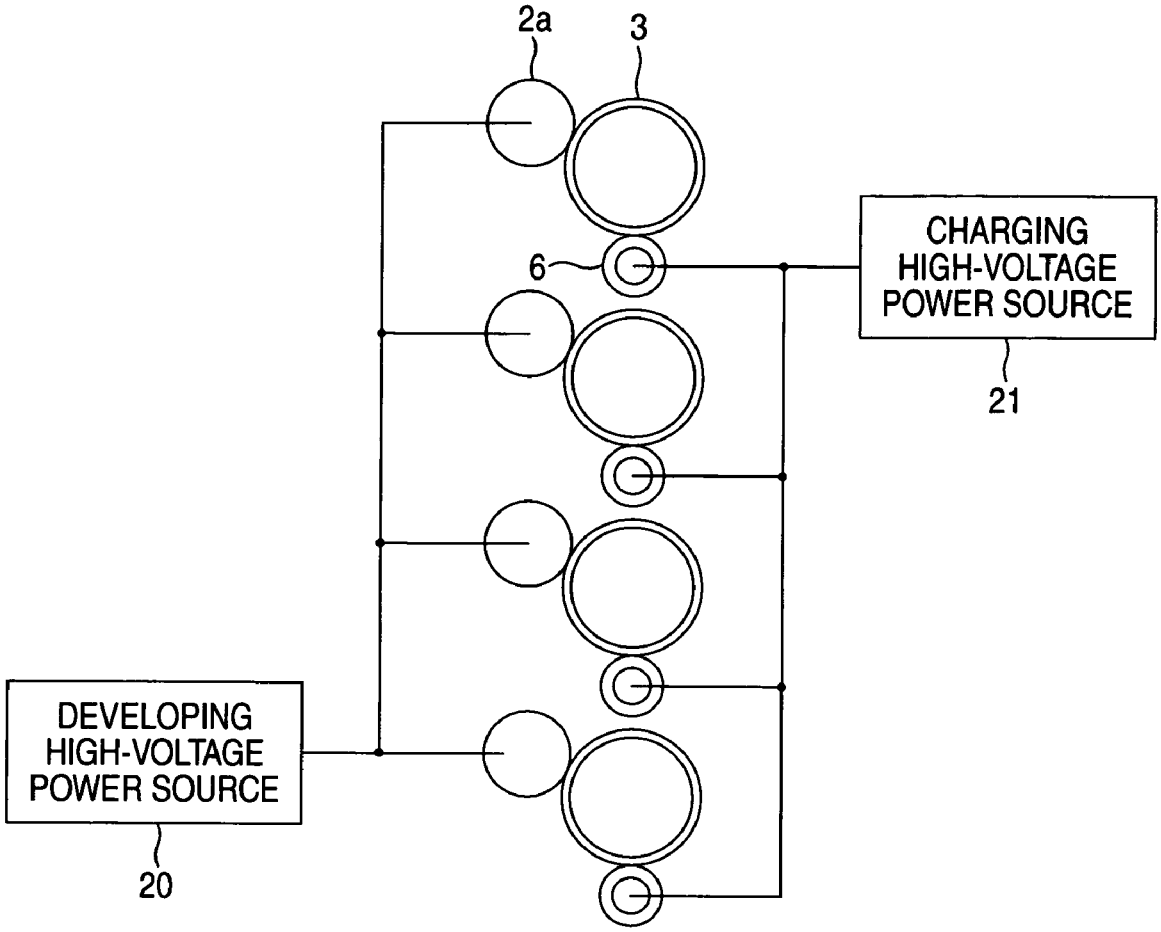
FIG. 1 is a view showing a structure of an image forming apparatus according to an embodiment of the invention.

FIG. 1 is a view showing the structure of a color image forming apparatus according to the embodiment of the invention. In the structure of FIG. 1, the developing rollers 2*a* for each color are connected to a common developing high-voltage power source 20 (a first high-voltage power source). Moreover, the charging rollers 6 for each color are connected to a common charging high-voltage power source 21 (a second high-voltage power source). In FIG. 1, the developing rollers 2*a* and the charging rollers 6 for each color are respectively came into contact with the photosensitive drums 3. In the invention, a structure using the non-contact developing mechanism as described with reference to FIG. 13 can be employed in place of such a structure or the brush charging mechanism described with reference to FIGS. 4 and 5 can also be used in place of the charging roller 6.

In the invention, as a basic structure, the process control is changed in the color mode and the monochrome mode when the color image forming apparatus is operated in consideration of various characteristics of the developing mechanism and the charging mechanism. In a color image forming apparatus in which developing devices and charging device for respective colors are connected to a common power source respectively to reduce the cost of a power device, therefore, it is possible to carry out the process control in order to suppress the wasteful consumption of a toner and to prevent a deterioration in picture quality during an operation in the monochrome mode.

For the process control, more specifically, the charging bias voltage is controlled so as to more raise an inverse contrast potential in the monochrome mode than that in the color mode. In the roller charging mechanism superposing an alternating voltage, moreover, it is also possible to carry out a control for turning OFF the alternating voltage in the monochrome mode. In a non-contact development using a nonmagnetic toner having one component, furthermore, a control is carried out so as to more raise the frequency of the alternating bias voltage in the monochrome mode than that in the color mode.

Referring to specific examples of the invention, in first to third examples, description will be given to an example in which a charging bias voltage and a developing bias voltage in a color mode and a monochrome mode are formed.

FIRST EXAMPLE

By using charging rollers as charging mechanisms, a voltage is supplied to all the charging rollers by a single charging power source in a tandem machine using a contact developing mechanism. Moreover, a voltage is supplied to all developing rollers by a single developing power source. In this case, referring to a color mode and a monochrome mode, a charging bias voltage and a developing bias voltage shown in Table 1 are set. In the example of the Table 1, the charging bias voltage in the color mode is set to be DC of −520V and AC of 1300V, and the charging bias voltage in the monochrome mode is set to be DC of −650V and AC of 1300V. Moreover, a developing bias voltage Vdc is set to be −270V in both the color mode and the monochrome mode.

TABLE 1

| | Color mode | Monochrome mode |
|---|---|---|
| Charging bias volage | DC −520 V<br>AC 1300 V | DC −650 V<br>AC 1300 V |
| Developing bias volage | Vdc = −270 V | Vdc = −270 V |

In the case in which the charging bias voltage and the developing bias voltage were set as shown in the Table 1, recording papers of 1000 sheets were printed in the monochrome mode in a state in which low potentials, that is, a charging potential of −520V and an inverse contrast potential of 250V are formed. Moreover, recording papers of 1000 sheets were printed in the monochrome mode in a state in which high potentials, that is, a charging potential of −650V and an inverse contrast potential of 380V are formed. In this case, the weight of the toner decreased from a toner cartridge, that is, the amount of toner consumption was obtained as shown in Table 2. From this result, it is apparent that the amount of toner consumption is decreased if the inverse contrast potential is increased.

TABLE 2

| Inverse contrast potential | Yellow toner | Magenta toner | Cyan toner |
|---|---|---|---|
| 250 V | 4.3 g | 3.7 g | 3.3 g |
| 380 V | 0.2 g | 0.1 g | 0.2 g |

SECOND EXAMPLE

In the same manner as in the first example, a charging roller is used as a charging mechanism and a tandem machine using a contact developing mechanism is intended. The developing bias voltage is set to be −270V in both a color mode and a monochrome mode in the same manner as in the first example. Referring to a charging bias voltage, a DC voltage is −520V and an alternating voltage is 1300V in the color mode. Referring to a charging bias voltage in the monochrome mode, moreover, a DC voltage is −1250V and an alternating voltage is not applied.

As a result, in the monochrome mode, a breakdown voltage is approximately 600V so that a charging potential is approximately −650V. Although a variation in the charging potential is increased, printing in the monochrome mode is rarely influenced. Referring to the charging bias voltage, moreover, the application of the alternating voltage is turned OFF so that the life of a power source is prolonged. More specifically, it is possible to control the charging bias voltage by selecting the application of only a DC voltage or the superposition and application of an alternating voltage on and to the DC voltage depending on a situation as to whether a variation in a potential is lessened or the life of an AC power source is prolonged. Referring to the second example, Table 3 shows the charging bias voltage and the developing bias voltage which are to be applied in the color mode and the monochrome mode.

TABLE 3

| | Color mode | Monochrome mode |
|---|---|---|
| Charging bias voltage | DC −520 V AC 1300 V | DC −1250 V AC (OFF) |
| Developing bias voltage | Vdc = −270 V | Vdc = −270 V |

THIRD EXAMPLE

Next, an example of a brush charging mechanism will be described. In this example, the same voltage is supplied to all brush rollers by one charging power source in a tandem machine having a non-contact developing mechanism. Moreover, the same voltage is supplied to all developing rollers by one developing power source. Referring to a charging bias voltage, a DC voltage of −520V and an alternating voltage of 900V are applied in a color mode and a monochrome mode. Referring to a developing bias voltage, furthermore, a DC voltage is −300V in the color mode, an alternating voltage has a voltage value of 1400V, a frequency of 2000 Hz, and a duty of 60%. In the monochrome mode, the DC voltage is −300V, the alternating voltage has a voltage value of 1400V, a frequency of 4000 Hz, and a duty of 60%. In the third example, Table 4 shows the charging bias voltage and the developing bias voltage which are applied in the color mode and the monochrome mode.

TABLE 4

| | Color mode | Monochrome mode |
|---|---|---|
| Charging bias voltage | Vdc = −520 V, Vpp = 900 V | Vdc = −520 V, Vpp = 900 V |
| Developing bias voltage | Vdc = −300 V, Vpp = 1400 V, f = 2000 Hz, Duty = 60% | Vdc = −300 V, Vpp = 1400 V, f = 4000 Hz, Duty = 60% |

Recording papers of 1000 sheets were printed in the monochrome mode at a frequency of 2000 Hz and 4000 Hz, respectively. Then, the amount of a consumed toner was obtained from the weight of a toner cartridge which was measured. Consequently, Table 5 was obtained. From the Table 5, it is apparent that the frequency in the monochrome mode is set to be higher than that in the color mode, thereby decreasing the amount of toner consumption.

TABLE 5

| Developing frequency | Yellow toner | Magenta toner | Cyan toner |
|---|---|---|---|
| 2000 Hz | 5.7 g | 4.2 g | 4.9 g |
| 4000 Hz | 0.5 g | 0.2 g | 0.6 g |

In many cases, the printing in the monochrome mode is used at time of document creation. For the printing of characters, a digital gradation is usually carried out and importance is not attached to a gradation property differently from the printing of a pattern. For this reason, a variation in a charging potential can be set with more allowance in the printing in the monochrome mode than that in the color mode. For this reason, the charging potential can be increased in the monochrome mode as shown in the Tables 1 and 3.

Thus, the charging potential is increased in the monochrome mode. Consequently, the inverse contrast potential in a non-image section (a white portion) is also increased in developing devices for yellow (Y), magenta (M) and cyan (C) other than black (Bk). As described with reference to FIG. 12, therefore, the wasteful consumption of the toner is eliminated. Such a state is confirmed by the measurement of a toner concentration and a microscopic observation.

As described in the Table 4, moreover, in the case in which the non-contact developing mechanism is used, it is effective that a frequency is set to be higher in the monochrome mode than that in the color mode in order to reduce the amount of toner consumption. In the non-contact developing mechanism, as described with reference to FIGS. 15 to 17, the toner reciprocates between the developing roller and a photosensitive drum. Depending on the developing bias potential in this case, the toner is developed onto the photosensitive drum or is recovered by the developing roller.

When the frequency of the developing bias voltage to be applied is increased, a time taken for applying a voltage on the development promoting side to the photosensitive drum is shortened. Moreover, a time taken for applying a voltage on the attracting side to the developing roller is also shortened. For this reason, the toner is returned toward the developing roller side before reaching the photosensitive drum in the non-image section. On the other hand, an electric field on the development promoting side is greater than that on the attracting side in the image section and the toner is finally developed onto the photosensitive drum.

In the color image forming apparatus using the non-contact developing mechanism, thus, if the frequency of the developing bias voltage is thus increased as in the invention, the gradation property is not presented and scumming is not generated. For this reason, the amount of wasteful toner consumption can be reduced and a deterioration in picture quality can be prevented. In the third example of the Table 4, the charging bias voltage is set to be identical in both the color mode and the monochrome mode. In the invention, also in the case in which the non-contact developing mechanism is used, it is also possible to employ a structure in which the charging bias voltage is changed in the color mode and the monochrome mode.

Figure 20:
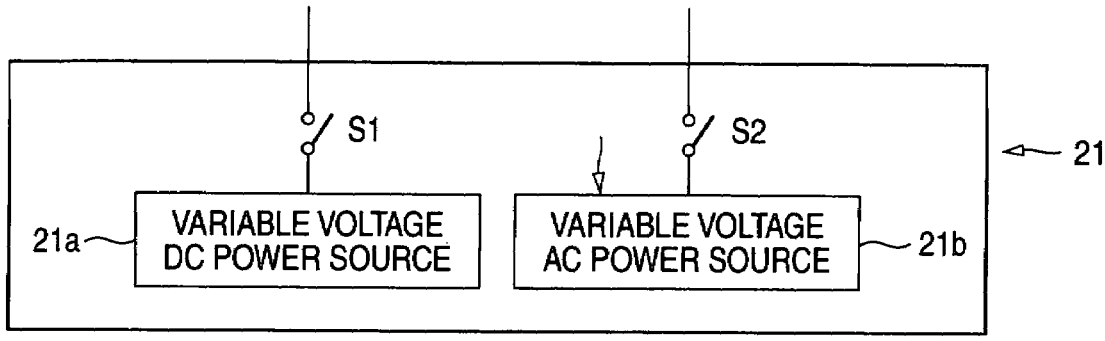
FIG. 20 is a block diagram showing a charging high-voltage power source.
Figure 21:
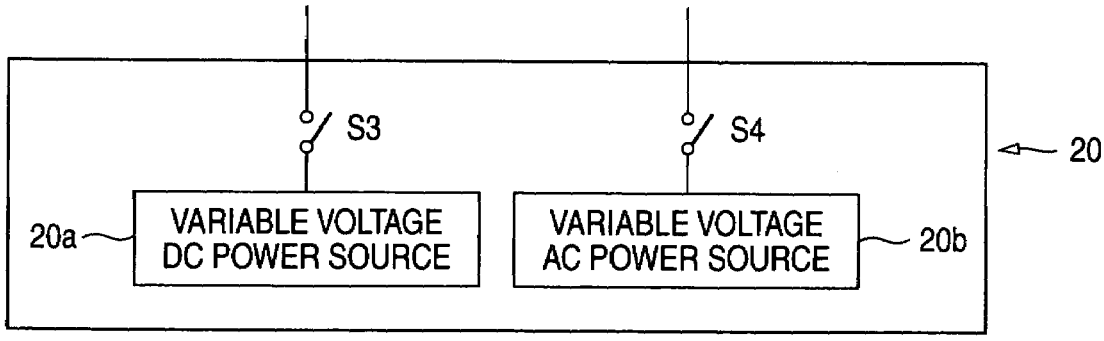
FIG. 21 is a block diagram showing a developing high-voltage power source.

FIG. 20 is a block diagram showing the charging high-voltage power source (the second high-voltage power source) 21 described with reference to FIG. 1, and FIG. 21 is a block diagram showing the developing high-voltage power source (the first high-voltage power source) 20 described with reference to FIG. 1. In FIG. 20, 21*a* denotes a variable voltage DC power source, 21*b* denotes a variable voltage AC power source, and S1 and S2 denote switches. In FIG. 21, moreover, 20*a* denotes a variable voltage DC power source, 20*b* denotes a variable frequency AC power source, and S3 and S4 denote switches. By using the power devices shown in FIGS. 20 and 21, description will be given to an example in which the charging bias voltage and the developing bias voltage described in the Table 1 (the first example), the Table 3 (the second example) and the Table 4 (the third example) are set.

In the first example of the Table 1, the charging roller is used as the charging mechanism and the contact developing mechanism is used as the developing mechanism. In this case, the switches S1 to S3 are closed and the switch S4 is opened. More specifically, an alternating developing bias voltage is not applied to the developing roller. In a processing in the color mode, a charging bias voltage having DC of −520V and a charging bias voltage having AC of 1300V are applied to the charging roller. Moreover, a developing bias voltage having DC of −270V is applied to the developing roller.

In a processing in the monochrome mode, a charging bias voltage having DC of −650V and a charging bias voltage having AC of 1300V are applied to the charging roller. Moreover, a developing bias voltage having DC of −270V is applied to the developing roller. Thus, different DC voltages of −520V in the color mode and −650V in the monochrome mode are output from the variable voltage DC power source 21*a*. The DC voltage is controlled by the switching of a storage battery, for example. The developing bias voltage is identical in both the color mode and the monochrome mode.

Also in the second example of the Table 3, the charging roller is used as the charging mechanism and the contact developing mechanism is used as the developing mechanism. In this case, the switch S4 is opened in both the color mode and the monochrome mode and an alternating developing bias voltage is not applied to the developing roller. In a processing in the color mode, the switches S1 to S3 are closed, and a charging bias voltage having DC of −520V and a charging bias voltage having AC of 1300V are applied to the charging roller. Moreover, a developing bias voltage having DC of −270V is applied to the developing roller.

In the processing in the monochrome mode, the switches S1 and S3 are closed and the switch S2 is opened. Accordingly, only a charging bias voltage having DC of −1250V is applied to the charging roller. Moreover, a developing bias voltage having DC of −270V is applied to the developing roller. In the examples of the Tables 1 and 3, thus, the bias voltage is switched in three stages of −520V, −650V and −1250V in the variable voltage DC power source 21*a*.

In the third example of the Table 4, the brush charging mechanism and the non-contact developing mechanism are used. In this case, all of the switches S1 to S4 are closed. In the processing in the color mode and the processing in the monochrome mode, a charging bias voltage having DC of −520V and a charging bias voltage having AC of 900V are applied to the charging roller. In the processing in the color mode, moreover, a developing bias voltage having DC of −300V, and an alternating voltage having a peak value of 1400V, a frequency of 2000 Hz and a duty of 60% are applied to the developing roller. In the processing in the monochrome mode, a developing bias voltage having DC of −300V, and an alternating voltage having a peak value of 1400V, a frequency of 4000 Hz and a duty of 60% are applied to the developing roller.

The variable frequency AC power source 20*b* serves to change the cycle of a rectangular wave and has a pulse generating circuit as described in the waveform diagram of FIG. 14. Although, in the first example of the Table 1, an alternating voltage (a pulse voltage) of 1300V is applied to the charging roller in the monochrome mode, a frequency can be optionally set. In the third example of the Table 4, moreover, an alternating voltage of 900V is applied to the charging roller in the color mode and the monochrome mode. However, in this case, a frequency can be optionally set.

In both the case in which the charging roller is used as the charging mechanism and the contact developing mechanism is used as the developing mechanism by utilizing the power devices in FIGS. 20 and 21 and the case in which the brush charging mechanism and the non-contact developing mechanism are used, thus, the charging bias voltage and the developing bias voltage can be formed.

Moreover, the developing high-voltage power source (the first high-voltage power source) has a variable voltage DC power source and a variable frequency AC power source. Therefore, it is possible to set the voltage value of the DC power source and the frequency of the AC power source to be optimum values, thereby carrying out the process control of a developing device. Moreover, the charging high-voltage power source (the second high-voltage power source) has a variable voltage DC power source and a variable voltage AC power source. Therefore, it is possible to set the voltage value of the DC power source and the voltage value of the AC power source to be optimum values, thereby carrying out the process control of a charging device.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A color image forming apparatus, comprising:

a plurality of image carriers for at least one color;

a plurality of developing devices, each developing a toner image onto each image carrier;

a plurality of charging devices, each charging the each image carrier;

a first power source, connected to the developing devices in common;

a second power source, connected to the charging devices in common; and a controller, which changes a process control of at least one of the charging devices and the developing devices such that the process control for at least one of the charging devices and the developing devices is different for a color image forming operation than for a monochrome image forming operation.

2. The color image forming apparatus as set forth in claim 1, wherein the first power source includes a variable voltage DC power source and a variable frequency AC power source.

3. The color image forming apparatus as set forth in claim 1, wherein the second power source includes a variable voltage DC power source and a variable voltage AC power source.

4. The color image forming apparatus as set forth in claim 1, wherein each charging device includes a roller charging mechanism or a brush charging mechanism.

5. The color image forming apparatus as set forth in claim 1, wherein:

each charging device includes a roller charging mechanism; and each developing device includes a contact developing mechanism.

6. The color image forming apparatus as set forth in claim 1, wherein:

each charging device includes a brush charging mechanism; and each developing device includes a non-contact developing mechanism.

7. The color image forming apparatus as set forth in claim 1, wherein the process control includes at least one of a control of a charging bias voltage for applying the charging devices and a control of a developing bias voltage for applying the developing devices.

8. The color image forming apparatus as set forth in claim 7, wherein the charging bias voltage includes either a DC voltage to be singly applied or an alternating voltage superposed with the DC voltage.

9. The color image forming apparatus as set forth in claim 7, wherein the developing bias voltage includes either a DC voltage to be singly applied or an alternating voltage superposed with the DC voltage.

10. The color image forming apparatus as set forth in claim 7, wherein the controller controls the charging bias voltage so that a voltage in the monochrome image forming operation is higher than a voltage in the color image forming operation.

11. The color image forming apparatus as set forth in claim 7, wherein the controller controls the developing bias voltage so that a frequency of an alternating voltage in the monochrome image forming operation is higher than a frequency of an alternating voltage in the monochrome image forming operation.

* * * * *